US008991977B2

(12) United States Patent
Yoneta

(10) Patent No.: US 8,991,977 B2
(45) Date of Patent: Mar. 31, 2015

(54) LIQUID DISCHARGE HEAD AND IMAGE FORMING APPARATUS

(71) Applicant: Ryota Yoneta, Tokyo (JP)

(72) Inventor: Ryota Yoneta, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 210 days.

(21) Appl. No.: 13/788,842

(22) Filed: Mar. 7, 2013

(65) Prior Publication Data

US 2013/0233948 A1 Sep. 12, 2013

(30) Foreign Application Priority Data

Mar. 12, 2012 (JP) ..... 2012-055171
Mar. 16, 2012 (JP) ..... 2012-059802

(51) Int. Cl.

| | |
|---|---|
| ***B41J 2/25*** | (2006.01) |
| ***B05B 1/14*** | (2006.01) |
| ***B05B 17/00*** | (2006.01) |
| ***B41J 2/14*** | (2006.01) |

(52) U.S. Cl.

CPC ..... *B05B 1/14* (2013.01); *B05B 17/0638* (2013.01); *B41J 2/14274* (2013.01); *B41J 2002/14403* (2013.01)

USPC ..... 347/47; 347/93

(58) Field of Classification Search

CPC ..... B41J 2/162; B41J 2/14201; B41J 2/1631

See application file for complete search history.

(56) References Cited

U.S. PATENT DOCUMENTS

| | | | |
|---|---|---|---|
| 7,287,847 | B2 | 10/2007 | Fujii et al. |
| 8,061,813 | B2 | 11/2011 | Matsuzawa et al. |
| 8,348,407 | B2 | 1/2013 | Matsufuji et al. |

FOREIGN PATENT DOCUMENTS

| | | |
|---|---|---|
| JP | 2007-253439 | 10/2007 |
| JP | 4228239 | 2/2009 |
| JP | 2010-018041 | 1/2010 |
| JP | 2011-025663 | 2/2011 |

*Primary Examiner* — Lamson Nguyen

(74) *Attorney, Agent, or Firm* — Cooper & Dunham LLP

(57) ABSTRACT

A liquid discharge head is disclosed that includes plural nozzles that discharge liquid droplets, plural individual channels that are in communication with the nozzles, a liquid introducing part that is in communication with the individual channels, a common liquid chamber that supplies liquid to the individual channels, and a filter part that is arranged between the common liquid chamber and the liquid introducing part. The filter part is configured to filter the liquid over a range of the individual channels in a nozzle array direction. A partition wall that partitions the individual channels has an end portion towards the liquid introducing part that is arranged to have a width in the nozzle array direction that becomes gradually narrower towards a tip of the partition wall. Further, at least a portion of the end portion of the partition wall is arranged to face the filter part.

10 Claims, 18 Drawing Sheets

LIQUID DISCHARGE HEAD AND IMAGE FORMING APPARATUS

BACKGROUND OF THE INVENTION

1. Field of the Invention

The disclosures herein generally relate to a liquid discharge head and an image forming apparatus.

2. Description of the Related Art

Image forming apparatuses such as a printer, a facsimile machine, a copier, a plotter, and a multifunction peripheral (MFP) combining one or more of the above functions include the inkjet recording apparatus, which is a liquid discharge type image forming apparatus that uses a recording head including a liquid discharge head (liquid droplet discharge head) that discharges liquid droplets, for example.

It is noted that liquid discharge defects may occur at the liquid discharge head when foreign matter enters the liquid discharge head and mixes with liquid contained therein. Thus, the liquid discharge head has a filter member arranged in its channel for filtering the liquid.

For example, Japanese Laid-Open Patent Publication No. 2011-025663 (Patent Document 1) discloses a liquid discharge head having a filter member that filters liquid over an entire area of plural liquid chambers in the nozzle array direction, the filter member including a vibrating plate member arranged between a common liquid chamber and a liquid introducing part that is in communication with plural liquid chambers communicating with plural nozzles. The liquid introducing part includes at least a portion facing the filter member that is continuous in the nozzle array direction. The filter member of the disclosed liquid discharge head has plural ribs arranged in the nozzle array direction at intervals of at least two of the liquid chambers.

Also, Japanese Laid-Open Patent Publication No. 2010-018041 (Patent Document 2) discloses a liquid discharge head that has a filter with a lower resistance arranged at a region supplying ink to a liquid chamber in communication with a nozzle that discharges a relatively large amount of liquid droplets compared to the resistance of a filter arranged at a region supplying ink to a liquid chamber in communication with a nozzle that discharges a relatively small amount of liquid droplets.

However, in the above disclosed liquid discharge heads, partition walls for partitioning the liquid chambers are not arranged over the filter member. Also, because the end portions of the partition walls at the filter member side are rectangular, a stagnant region may be formed between the vibration plate member and a channel plate near the partition wall edge portions, and air bubbles may accumulate in this region.

SUMMARY OF THE INVENTION

It is a general object of at least one embodiment of the present invention to provide a liquid discharge head that substantially obviates one or more problems caused by the limitations and disadvantages of the related art.

In one embodiment of the present invention, a liquid discharge head is provided that includes plural nozzles that discharge liquid droplets, plural individual channels that are in communication with the nozzles, a liquid introducing part that is in communication with the individual channels, a common liquid chamber that supplies liquid to the individual channels, and a filter part that is arranged between the common liquid chamber and the liquid introducing part. The filter part is configured to filter the liquid over a range of the individual channels in a nozzle array direction. A partition wall that partitions the individual channels has an end portion towards the liquid introducing part that is arranged to have a width in the nozzle array direction that becomes gradually narrower towards a tip of the partition wall. Further, at least a portion of the end portion of the partition wall is arranged to face the filter part.

According to an aspect of the present invention, air bubble discharge performance of a liquid discharge head may be improved, for example. According to another aspect of the present invention, liquid supply performance of the liquid discharge head may be improved, for example.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
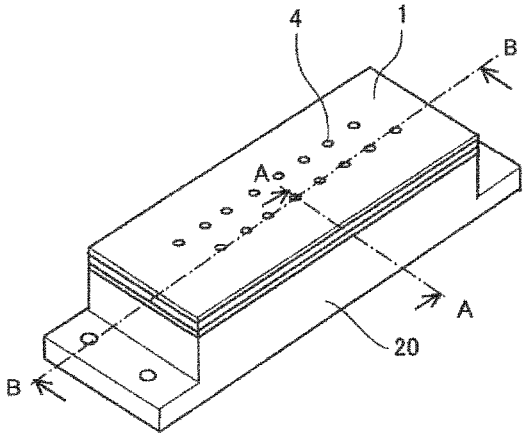
FIG. 1 is an external perspective view of a liquid discharge head according to a first embodiment of the present invention.

In the following, embodiments of the present invention are described with reference to the accompanying drawings. It is noted that identical or corresponding features shown in more than one of the drawings may be given the same reference numerals and their descriptions may be omitted.

Figure 2:
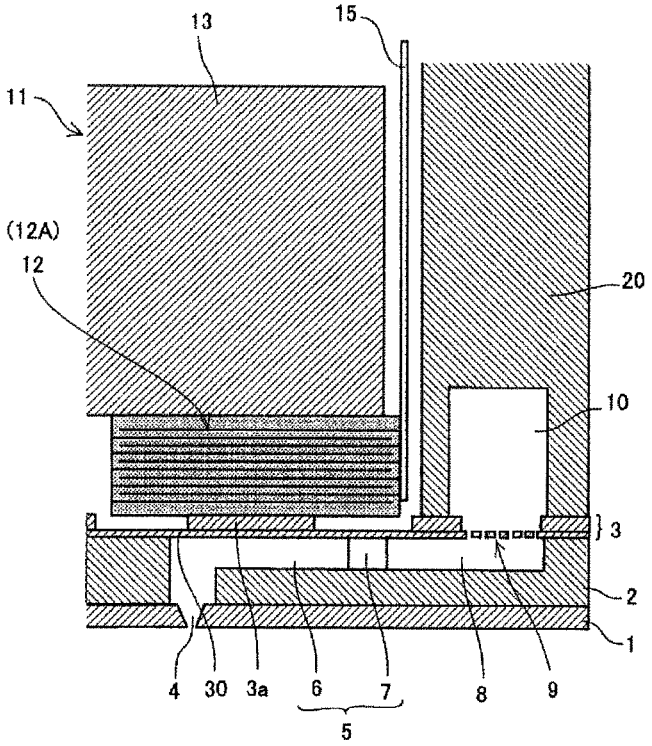
FIG. 2 is a cross-sectional view of the liquid discharge head across section A-A of FIG. 1.
Figure 3:
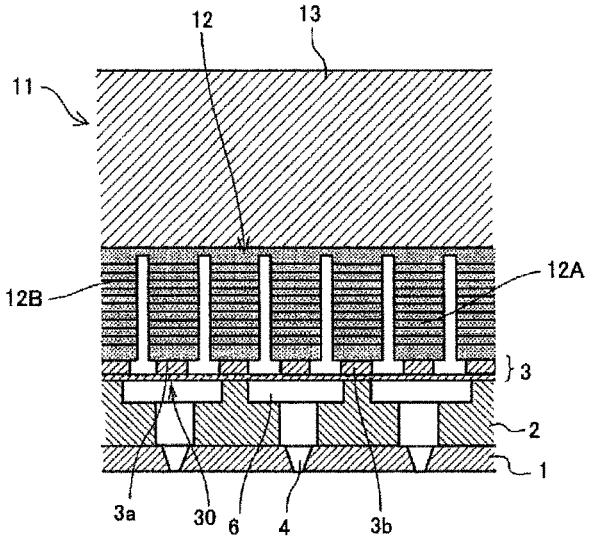
FIG. 3 is a cross-sectional view of the liquid discharge head across section B-B of FIG. 1.

First, a liquid discharge head according to a first embodiment of the present invention is described below with reference to FIGS. 1-3. FIG. 1 is an external perspective view of the liquid discharge head; FIG. 2 is a cross-sectional view of the liquid discharge head across section A-A of FIG. 1 along a direction substantially perpendicular to a nozzle array direction (liquid chamber longitudinal direction); and FIG. 3 is a cross-sectional view of the liquid discharge head across section B-B of FIG. 1 along the nozzle array direction (liquid chamber lateral direction).

The liquid discharge head includes a nozzle plate 1, a channel plate (liquid chamber substrate) 2, and a vibrating plate member 3 made of a thin film that are layered and bonded together. The liquid discharge head also includes a piezoelectric actuator 11 that deforms the vibrating plate member 3, and a frame member 20 corresponding to a common channel member.

The nozzle plate 1, the channel plate 2, and the vibrating plate member 3 form plural liquid chambers (also referred to as "pressure liquid chamber," "pressure chamber," "pressurization chamber," or "channel," for example) 6 that are in communication with plural nozzles 4 that discharge liquid droplets, a liquid supply path 7 that supplies liquid to the liquid chambers 6 and also acts as a fluid resistor, and a liquid introducing part 8 that is in communication with the liquid supply path 7. It is noted that in the present embodiment, an individual channel 5 is formed by the liquid chamber 6 and the liquid supply path 7 including the fluid resistor. However, in other embodiments, the fluid resistor may be omitted and liquid may be supplied directly from the liquid introducing part 8 to the liquid chamber 6 in which case the liquid chamber 6 may form the individual channel 5.

The frame member 20 includes a common liquid chamber 10 corresponding to a common channel. The vibrating plate member 3 includes a filter part 9. Liquid is supplied to the plural liquid chambers 6 from the common liquid chamber 10, via the filter part 9, the liquid introducing part 8, and the liquid supply path 7.

In the present embodiment, an electroformed nickel (Ni) plate is used as the nozzle plate 1. However, the present invention is not limited to such an embodiment and other metal members, resin members, and resin-metal laminated members may be used instead, for example. The nozzle plate 1 has a nozzle 4 having a diameter of 10-35 μm, for example, for each of the liquid chambers 6. The nozzle plate 1 is bonded to the channel plate 2 with adhesive. Further, a water repellent layer is arranged on the liquid droplet discharge face of the nozzle plate 1 (i.e., discharging direction side surface, discharging face, or face on the opposite side of the liquid chamber 6).

In the present embodiment, the channel plate 2 is created by etching a single crystal silicon substrate to form trenches corresponding to the liquid chambers 6, the liquid supply path 7, and the liquid introducing part 8, for example. It is noted that in other embodiments the channel plate 2 may be created by etching a metal plate such as a SUS substrate using an acid etching solution, or by mechanically processing (e.g., pressing) a metal plate, for example.

The vibrating plate member 3 includes a deformable vibrating region 30 at a portion corresponding to the liquid chamber 6. The vibrating plate member 3 also acts as a wall face member forming a wall of the liquid chamber 6 of the channel plate 2.

The piezoelectric actuator 11 including an electromechanical conversion element as a drive means (actuator means, pressure generating means) for deforming the vibrating region 30 is arranged on the vibrating plate member 3 at the opposite side of the liquid chamber 6.

The piezoelectric actuator 11 includes layered piezoelectric members 12 that are bonded to a base member 13 with adhesive. Each of the piezoelectric members 12 is groove-processed by half-cut dicing to form a desired number of piezoelectric pillars 12A and 12B at certain intervals in the form of a comb.

The piezoelectric pillars 12A and 12B of the piezoelectric members 12 have substantially identical configurations and differ in that a driving waveform is applied to the piezoelectric pillars 12A to drive the piezoelectric pillars 12A while no driving waveform is applied to the piezoelectric pillars 12B so that the piezoelectric pillars 12B are used simply as support pillars.

The driven piezoelectric pillar 12A is bonded to a corresponding convex portion 3*a* formed at the vibrating region 30 of the vibrating plate member 3.

The piezoelectric member 12 is a layered structure formed by alternately layering a piezoelectric material layer and an internal electrode. The internal electrode is drawn out to an end face and is connected to an external electrode. Further, a FPC (flexible printer circuit) 15 as a flexible wiring substrate for supplying a drive signal to the external electrode is connected to the driven pillar 12A.

The frame member 20 is created through injection molding using a resin material such as epoxy resin or a polyphenylenesulfide (PPS) resin corresponding to a thermo-reversible resin, for example. The frame member 20 forms the common liquid chamber 10 to which liquid is supplied from a head tank or a liquid cartridge (not shown), for example.

In the liquid discharge head having the above configuration, for example, a voltage applied to the driven pillar 12A may be lowered with respect to a reference potential so that the driven pillar 12A may contract and the vibrating region 30 of the vibrating plate member 3 may be deformed. As a result, the capacity (volume) of the liquid chamber 6 may increase to cause liquid to flow inside the liquid chamber 6. Then, the voltage applied to the driven pillar 12A may be raised so that the driven pillar 12A may expand in the layering direction and the vibrating region 30 of the vibrating plate member 3 may be deformed in a direction of the nozzle 4 to decrease the capacity (volume) of the liquid chamber 6. As a result, the liquid within the liquid chamber 6 may be pressurized so that liquid droplets may be discharged from the nozzle 4.

Then, the voltage applied to the driven pillar 12A may be set back to the reference potential so that the vibrating region 30 of the vibrating plate member 30 may be restored to its initial position. In this case, because the liquid chamber 6 is expanded and a negative pressure is generated, liquid from the common liquid chamber 10 is supplied to the liquid chamber 6 via the liquid supply path 7. Thus, the next liquid droplet discharge operations are performed after meniscus vibration at the nozzle 4 is attenuated and stabilized.

It is noted that the method of driving the liquid discharge head is not limited to the above-described example (i.e., pull-push method). In other examples, the so-called push method or the pull method may be used in accordance with the direction in which the driving waveform is applied.

Figure 4:
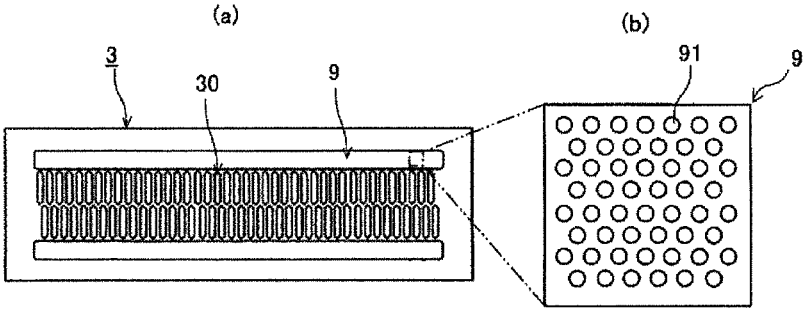
FIG. 4 is a plan view of a vibrating plate member of the liquid discharge head of the first embodiment.

In the following, the liquid discharge head according to the first embodiment is described in detail with reference to FIGS. 4 and 5. FIG. 4 is a plan view the filter part 9 of the vibrating plate member 3; and FIG. 5 is a plan view of the liquid introducing part 8 and the individual channels 5.

Referring to FIG. 4, the vibrating plate member 3 has the filter part 9 for filtering liquid arranged across the entire range of the individual channels 5 in the nozzle array direction, and the filter part 9 has multiple filter holes 91 for filtering the liquid.

Figure 5:
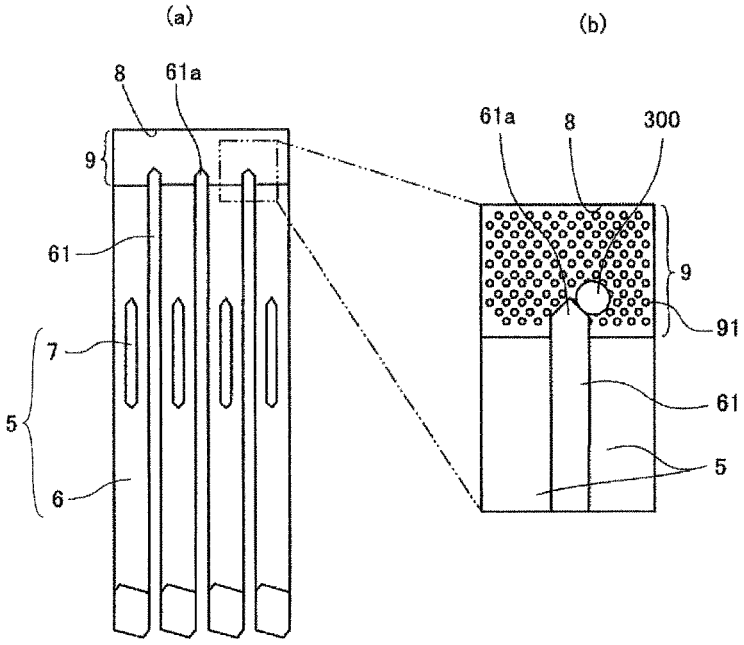
FIG. 5 is a plan view of a liquid introducing part and individual channels of the liquid discharge head of the first embodiment.

Referring to FIG. 5, the individual channels 5 are separated by partition walls 61, and end portions 61*a* of the partition walls 61 toward the liquid introducing part 8 are arranged to have narrowed widths in the nozzle array direction. In the present embodiment, the end portions 61*a* of the partition walls 61 are arranged into tapered shapes.

The end portions 61*a* corresponding to the tapered portions of the partition walls 61 and portions of the partition walls 61 extending from the end portions 61*a* towards the individual channel 5 side are arranged to face a portion of the filter part 9.

That is, the partition walls 61 do not extend across the entire range of the filter part 9 in the direction perpendicular to the nozzle array direction at the liquid introducing part 8. Instead, the partition walls 61 are arranged to face merely a portion of the filter part 9. In this way, the liquid introducing part 8 may have a continuous portion extending across the entire range of the individual channels 5 in the nozzle array direction.

By arranging the end portions 61*a* of the partition walls 61 facing the filter part 9 into tapered shapes, stagnation of the liquid flowing from the common liquid chamber 10 to the liquid introducing part 8 through the filter holes 91 of the filter part 9 near the end portions 61*a* of the partition walls 61 may be reduced.

Also, by arranging the filter holes 91 of the filter part 9 around the end portions 61*a* of the partition walls 61, an adequate liquid flow rate may be secured near the end portions 61*a* of the partition walls 61.

In this way, as is shown in FIG. 5 (*b*), even when an air bubble 300 is stuck to an edge face of the end portion 61*a* of the partition wall 61, the liquid introduced into the liquid introducing part 8 may flow along the tapered side of the end portion 61*a* at an adequate flow rate so that the air bubble 300 may flow into the liquid chamber 6 and be discharged from the nozzle 4.

In the following, configurations of the partition walls 61 according to comparative examples are described with reference to FIGS. 6-8.

Figure 6:
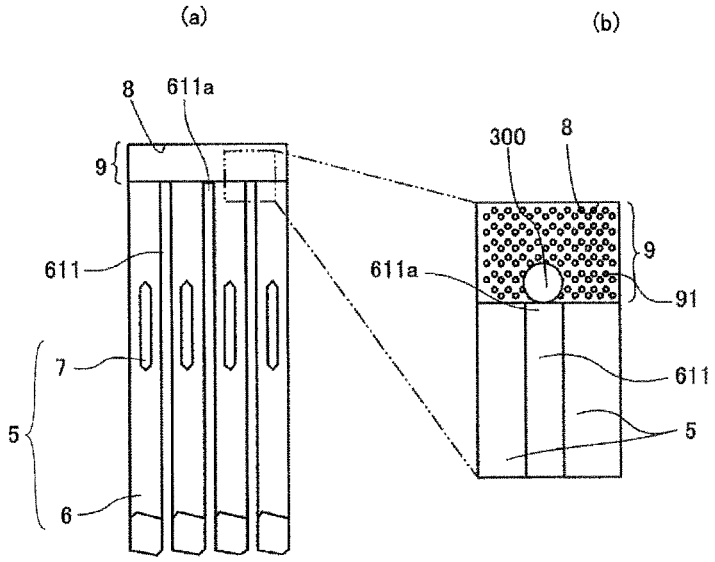
FIG. 6 is a plan view of a liquid introducing part and individual channels of a first comparative example.

FIG. 6 illustrates a first comparative example in which the end portions 61*a* of the partition walls 61 are arranged into rectangular shapes and the partition walls 61 are not arranged to face the filter part 9.

In the first comparative example, the end portions 61*a* of the partition walls 61 are arranged into rectangular shapes that have comparatively high fluid resistance so that stagnation of the liquid flow occurs near the end portions 61*a*. Also, since the end portions 61*a* are not arranged to face the filter part 9, an adequate liquid flow rate may not be secured near the end portions 61*a*. As a result, the liquid flow rate may slow down near the end portions 61*a* so that the air bubble 300 stuck to the edge face of the end portion 61*a* may not be easily discharged.

Figure 7:
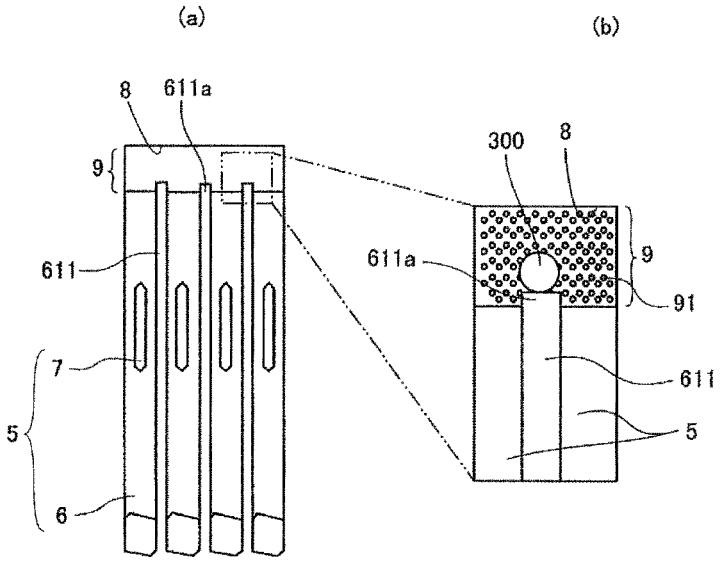
FIG. 7 is a plan view of a liquid introducing part and individual channels of a second comparative example.

FIG. 7 illustrates a second comparative example in which the end portions 61*a* of the partition walls 61 are arranged into rectangular shapes as in the first comparative example, but the end portions 61*a* are arranged to face a portion of the filter part 9.

In the second comparative example, although the filter holes 91 are arranged near the end portions 61*a* in a manner similar to the first embodiment, the end portions 61*a* are arranged into rectangular shapes that have comparatively high fluid resistance so that stagnation of the liquid flow occurs near the and portions 61*a* and the air bubble 300 stuck to the end portion 61*a* may not be easily discharged.

Figure 8:
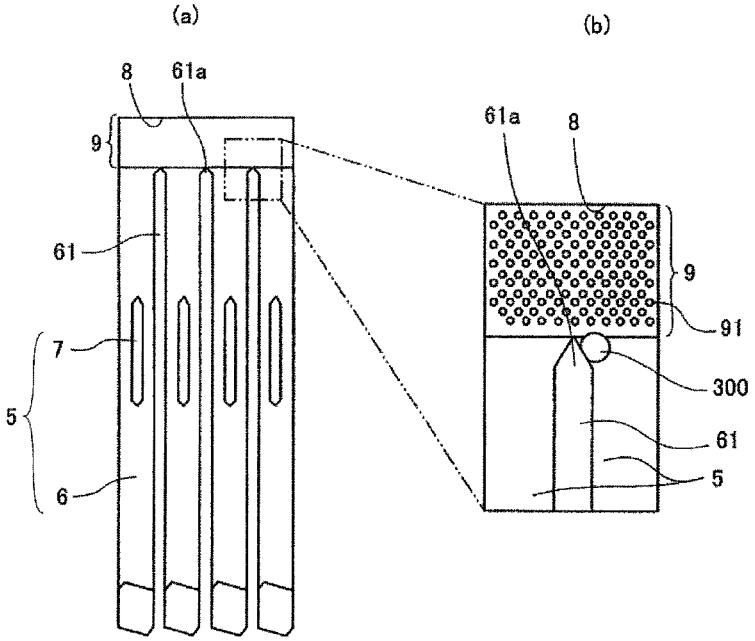
FIG. 8 is a plan view of a liquid introducing part and individual channels of a third comparative example.

FIG. 8 illustrates a third comparative example in which the end portions 61*a* of the partition walls 61 are arranged into tapered shapes in a manner similar to the first embodiment, but the partition walls 61 are not arranged to face the filter part 9.

In the third comparative example, because the filter holes 91 are not arranged near the end portions 61*a*, an adequate liquid flow rate may not be secured near the end portions 61*a*. As a result, the liquid flow rate may slow down near the end portions 61*a* so that the air bubble 300 stuck to the edge face of the end portion 61*a* may not be easily discharged.

On the other hand, in the first embodiment, the end portions 61*a* of the partition walls 61 are arranged into tapered shapes and the partition walls 61 are arranged to face a portion of the filter part 9. With such a configuration, stagnation of the liquid flow near the end portions 61*a* may be prevented and an adequate amount of liquid may flow at an adequate flow rate so that air bubble discharge performance of the liquid discharge head may be improved, for example.

Figure 9:
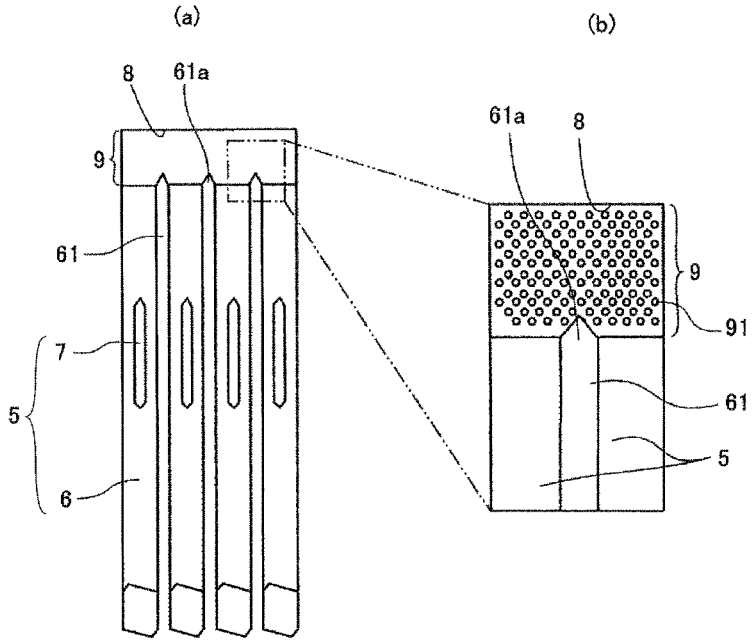
FIG. 9 is a plan view of a liquid introducing part and individual channels of a second embodiment of the present invention.

In the following, a second embodiment of the present invention is described with reference to FIG. 9. FIG. 9 is a plan view of the liquid introducing part 8 and the individual liquid channels 5 according to the second embodiment.

In the present embodiment, the end portions 61*a* of the partition walls 61 are arranged into tapered shapes in a manner similar to the first embodiment, but only the end portions 61*a* are arranged to face a portion of the filter part 9.

With such a configuration, an area of the filter part 9 where the partition walls 61 block the filter holes 91 may be reduced so that the amount of liquid that may flow through the filter part 9 may be increased compared to the first embodiment. In this way, the air bubble discharge performance of the liquid discharge head may be improved further, for example.

Figure 10:
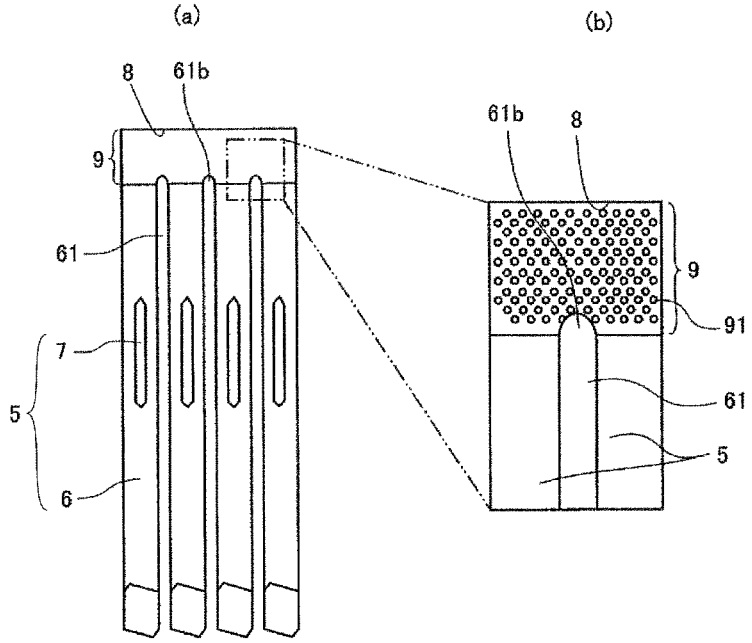
FIG. 10 is a plan view of a liquid introducing part and individual channels of a third embodiment of the present invention.

In the following, a third embodiment of the present invention is described with reference to FIG. 10. FIG. 10 is a plan view of the liquid introducing part 8 and the individual channels 5 according to the third embodiment.

In the present embodiment, end portions 61*b* of the partition walls 61 towards the liquid introducing part 8 that have narrowed widths in the nozzle array directions are arranged into curved shapes having peaks. Also, as in the second embodiment, only the end portions 61*b* of the partition walls 61 are arranged to face a portion of the filter part 9.

With such a configuration, an area of the filter part 9 where the partition walls 61 block the filter holes 91 may be reduced compared to the first embodiment so that the amount of liquid flowing through the filter holes 91 may be increased and air bubble discharge performance of the liquid discharge head may be improved, for example. Further, by arranging the end portions 61*b* into curved shapes, the fluid resistance of the partition walls 61 may be decreased compared to the second embodiment, for example.

Figure 11:
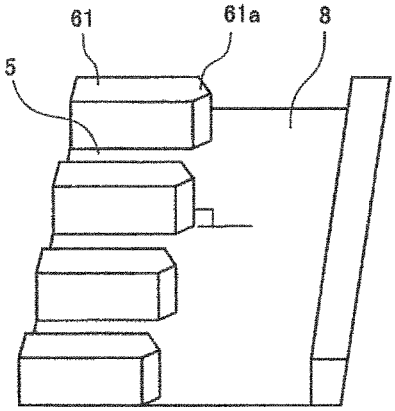
FIG. 11 is a perspective view of a liquid introducing part and individual channels of a fourth embodiment of the present invention.

In the following, a fourth embodiment of the present invention is described with reference to FIG. 11. FIG. 11 is a perspective view of the liquid introducing part 8 and the individual channels 5 according to the fourth embodiment.

In the present embodiment, the end portions 61*a* corresponding to tapered portions of the partition walls 61 are arranged to be substantially perpendicular to the bottom face of the liquid introducing part 8.

With such a configuration, a continuous region of the liquid introducing part 8 that extends across plural individual channels 5 may be enlarged so that liquid supply performance of the liquid discharge head may be improved, for example.

Figure 12:
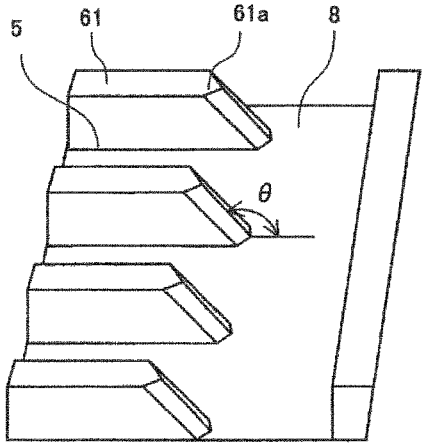
FIG. 12 is a perspective view of a liquid introducing part and individual channels of a fifth embodiment of the present invention.

In the following, a fifth embodiment of the present invention is described with reference to FIG. 12. FIG. 12 is a perspective view of the liquid introducing part 8 and the individual channels 5 according to the fifth embodiment.

In the present embodiment, the end portions 61*a* corresponding to tapered portions of the partition walls 61 are arranged to be inclined with respect to the bottom face of the liquid introducing part 8 towards the individual channel 5 side.

With such a configuration, the liquid flowing into the liquid introducing part 8 from the filter part 9 may flow smoothly towards the individual channels 5, for example.

It is noted that the end portions 61*a* according to the above embodiments of the present invention may be easily formed by etching silicon to create the channel plate 2. For example, the end portions 61*a* according to the first embodiment may be formed through anisotropic etching of silicon. The end portions 61*b* according to the third embodiment may be formed through isotropic etching of SUS, for example.

Figure 13A:
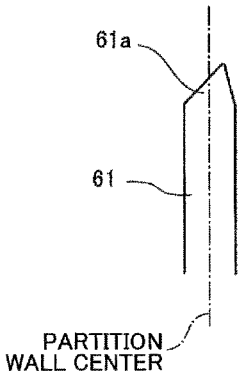
FIGS. 13A and 13B are plan views of the end portions of partition walls in modified embodiments of the present invention.
Figure 13B:
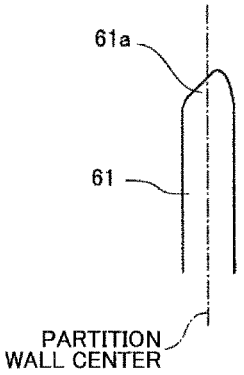

Also, it is noted that although the end portions 61*a* of the partition walls 61 are arranged to have tips positioned near the center of their wall widths, the shapes of the end portions 61*a* are not limited to the above embodiments. For example, in one modified embodiment, the tip of the end portion 81*a* may be shifted from the center of the partition wall width as is shown in FIG. 13A. Also, in another modified embodiment, the tip of the end portion 61*a* may be shifted from the center of the partition wall width and the edges of the end portion 61*a* may be curved as is shown in FIG. 13B. It is noted that similar effects such as improved air bubble discharge performance may be obtained in these modified embodiments as well.

Figure 14:
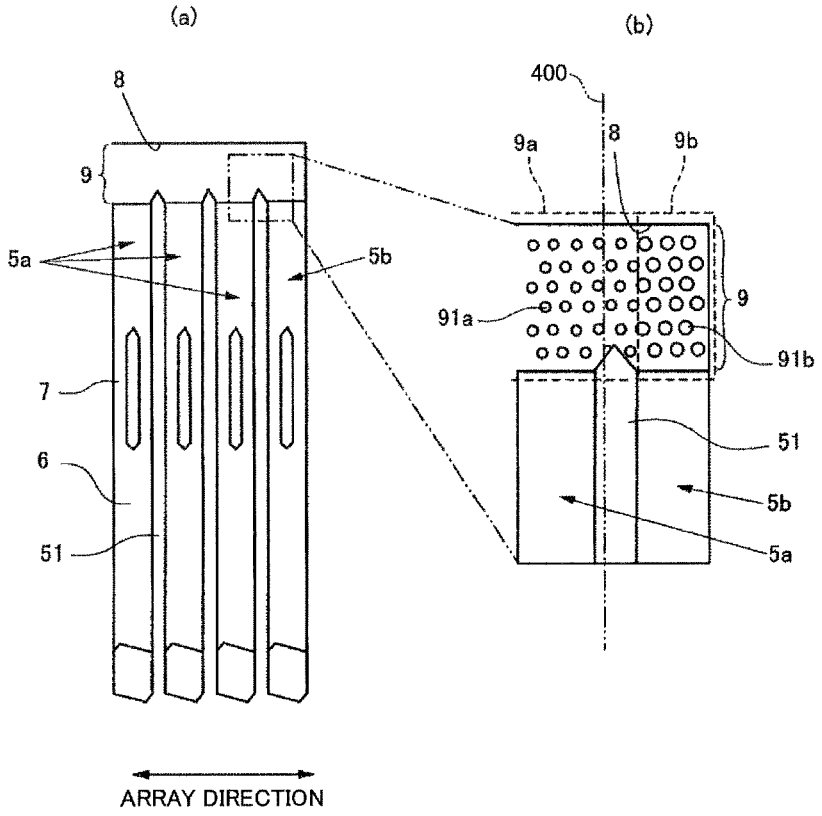
FIG. 14 is a plan view of a liquid introducing part and individual channels of a sixth embodiment of the present invention.

In the following, a sixth embodiment of the present invention is described with reference to FIG. 14. FIG. 14 is a plan view of the liquid introducing part 8 and the individual channels 5 according to the sixth embodiment.

In FIG. 14, partition walls 51 are arranged between the individual channels 5.

It is noted that in the following descriptions, the individual channel 5 that has adjacent individual channels 5 arranged at both sides in the channel array direction (nozzle array direction; simply referred to as "array direction" hereinafter) is denoted as first individual channel 5*a*, and the individual channel 5 that has an adjacent individual channel 5 arranged at only one side in the channel array direction is denoted as second individual channel 5*b*. In other words, the individual channels 5 positioned at the array direction side ends correspond to the second individual channels 5*b*, and the other individual channels 5 that are not positioned at the array direction side ends correspond to the first individual channels 5*a*.

In the present embodiment, the fluid resistance of a filter region (second filter region) 9*b* that faces a portion of the liquid introducing part 8 facing the second individual chamber 5*b* is arranged to be smaller than the fluid resistance of a filter region (first filter region) 9*a* that faces a portion of the liquid introducing part 8 facing the first individual chamber 5*a*.

Specifically, in the present embodiment, the diameter of filter holes 91*b* formed at the filter region 9*b* are arranged to be greater than the diameter of filter holes 91*a* formed at the filter region 9*a*. It is noted that the filter holes 91*a* and 91*b* at the filter regions 9*a* and 9*b* are arranged at the same pitch in the present embodiment.

With such a configuration, liquid may flow more easily from the common liquid chamber 10 to the liquid introducing part 8 through the filter region 9*b* that faces a portion of the liquid introducing part 8 facing the second individual chamber 5*b* compared to the filter region 9*a* that faces a portion of the liquid introducing part 8 facing the first individual chamber 5*a*.

In this way, liquid may be smoothly supplied to the second individual chamber 5*b* so that liquid supply performance of the liquid discharge head may be improved, and the liquid flow rate may be increased so that air bubble discharge performance of the liquid discharge head may be improved, for example.

Further, in a preferred embodiment, assuming the diameter of the nozzle 4 is 24 μm, a diameter Da of the filter hole 91*a* and a diameter Db of the filter hole 91*b* are arranged to satisfy the following relationship: 10 μm<Da<Db<24 μm. In this way foreign matter may be prevented from intruding into the nozzle 4 and desired liquid supply performance may be obtained, for example.

It is noted that in FIG. 14, the boundary between the filter region 9*a* and the filter region 9*b* is along a line extending from the side wall face of the partition wall 51 that is adjacent to the second individual channel 5*b*. However, the boundary between the filter region 9*a* and filter region 9*b* is not limited to such position. For example, to improve the air bubble discharge performance, the boundary between the filter region 90*a* and the filter region 90*b* may be arranged along a dot-dashed line 400 shown in FIG. 14 that is positioned between a tip of the partition wall 51 that is adjacent to the second individual channel 5*b* and the other side wall face of the partition wall 51 towards the first individual channel 5*a* side.

Further, it is noted that an air bubble trapped in the filter region 9*b* may be smaller than an air bubble trapped in the filter region 9*a* as is described in detail below with reference to FIGS. 15A and 15B. In this way, air bubble discharge performance of the liquid discharge head may be improved, for example.

Figure 15A:
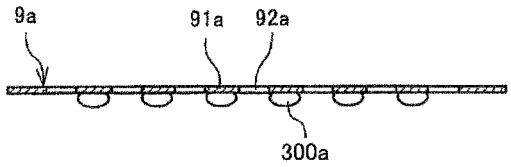
FIGS. 15A and 15B are cross-sectional views of a filter part of the sixth embodiment.
Figure 15B:
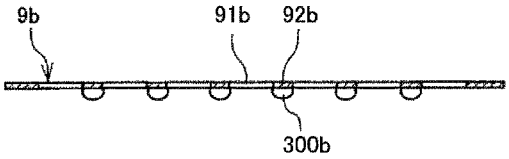

FIGS. 15A and 15B are cross-sectional views of the filter region 9*a* and the filter region 9*b*.

Because the diameter of the filter holes 91*a* formed at the filter region 9*a* is comparatively small, the area of a portion 92*a* of the filter region 9*a* other than the filter holes 91*a* is comparatively large. On the other hand, because the diameter of the filter holes 91*b* formed at the filter region 9*b* is comparatively large, the area of a portion 92*b* of the filter region 9*b* other than the filter holes 91*b* is comparatively small.

As a result, an air bubble 300*a* trapped in the filter region 9*a* may be larger than an air bubble 3006 trapped in the filter region 9*b*. Thus, the air bubble 3006 may be reliably discharged by the liquid flowing into the second individual channel 5*b*.

It is noted that when the filter holes 91*b* are arranged across the entire range of the filter part 9, although the liquid supply performance and the air bubble discharge performance of the second individual channels 5*b* may be improved, the overall filtering performance (particle trapping performance) of the filter part 9 may be degraded.

Thus, in the present embodiment, the filter diameter is enlarged at the filter region 9*b* that faces the portion of the liquid introducing part 8 facing the second individual channel 5*b* where the liquid supply performance is prone to degradation. In this way, degradation of the filtering performance may be prevented while securing adequate liquid supply performance at the second individual channels 5*b*.

In the following, the sixth embodiment is compared with an exemplary configuration shown in FIG. 16.

Figure 16:
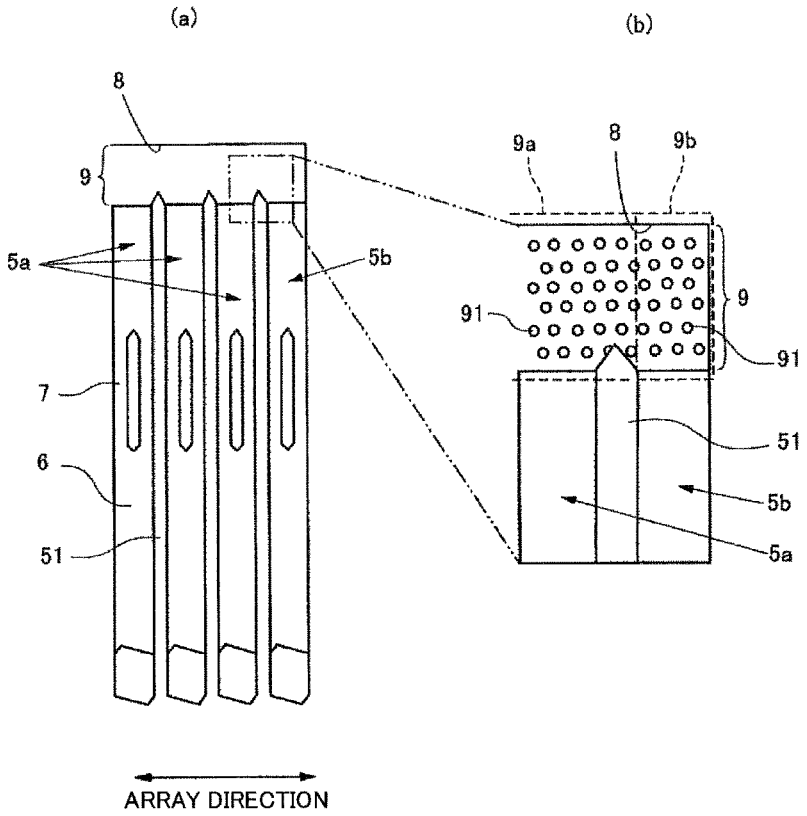
FIG. 16 is a plan view of a liquid introducing part and individual channels of another comparative example.

In FIG. 16, the filter holes 91 having the same diameter are arranged across the entire range of the filter part 9 at the same pitch.

With such a configuration, because the first individual channel 5*a* has adjacent individual channels 5 arranged at both sides in the array direction, the spread of the liquid introducing part 8 at the first individual channel 5*a* may be greater than that at the second individual channel 5*b* and a greater amount of the liquid introduced into the liquid introducing part 8 may flow into the first individual channel 5*a*. On the other hand, because the second individual channel 5*b* has an adjacent individual channel arranged at only one side in the array direction, the spread of the liquid introducing part 8 at the second individual channel 5*b* may be smaller than that at the first individual channel 5*a* so that a smaller amount of the liquid introduced into the liquid introducing part 8 may flow into the second individual channel 5*b*. As a result, the liquid supply performance of the second individual channel 5*b* may be lower than that of the first individual channel 5*a*.

In the sixth embodiment, arrangements are made to facilitate the introduction of liquid into the region corresponding to the second individual channel 5*b* so that substantially the same liquid supply performance as that at the first individual channel 5*a* may be secured at the second individual channel 5*b*, for example.

Figure 17:
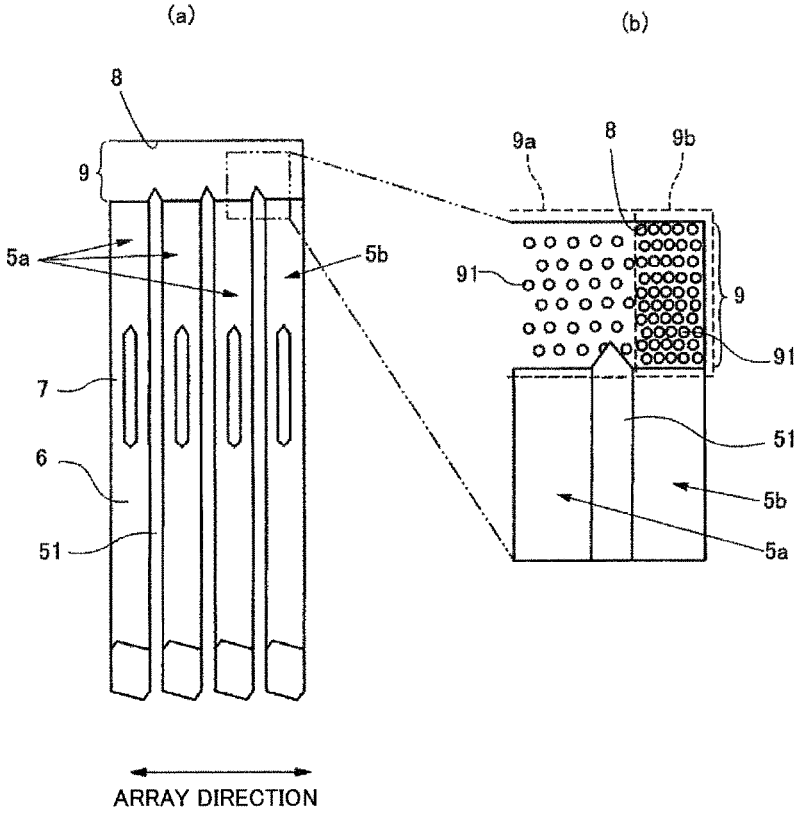
FIG. 17 is a plan view of a liquid introducing part and individual channels of a seventh embodiment of the present invention.

In the following, a seventh embodiment of the present invention is described with reference to FIG. 17. FIG. 17 is a plan view of the liquid introducing part 8 and the first and second individual channels 5*a* and 5*b* according to the seventh embodiment.

In the present embodiment, the pitch (filter hole pitch) of the filter holes 91 formed at the filter region 9*b* that faces the portion of the liquid introducing part 8 facing the second individual channel 5*b* is arranged to be smaller than the pitch of the filter holes 91 formed at the filter region 9*a* that faces the portion of the liquid introducing part 8 facing the first individual channel 5*a* so that the fluid resistance of the filter region 9*b* may be lower than the fluid resistance of the filter region 9*a*.

It is noted that when the filter holes 91 are arranged to be staggered as in the filter region 9*a* of FIG. 17, the pitch of the filter holes 91 corresponds to the spacing between adjacent filter holes 91.

With the configuration according to the seventh embodiment, liquid from the common liquid chamber 10 may flow more easily into the liquid introducing part 8 through the filter region 9*b* that faces the portion of the liquid introducing part 8 facing the second individual channel 5*b* compared to the filter region 9*a* that faces the portion of the liquid introducing part 8 facing the first individual channel 5*a*.

Also, by reducing the pitch of the filter holes 91 formed at the filter region 9*b*, the area of the portion of the filter region 9*b* that does not constitute the filter holes 91 may be reduced so that the size of air bubbles that may be trapped in the filter region 9*b* may be smaller. In this way, the air bubble discharge performance may be improved as in the sixth embodiment.

Figure 18:
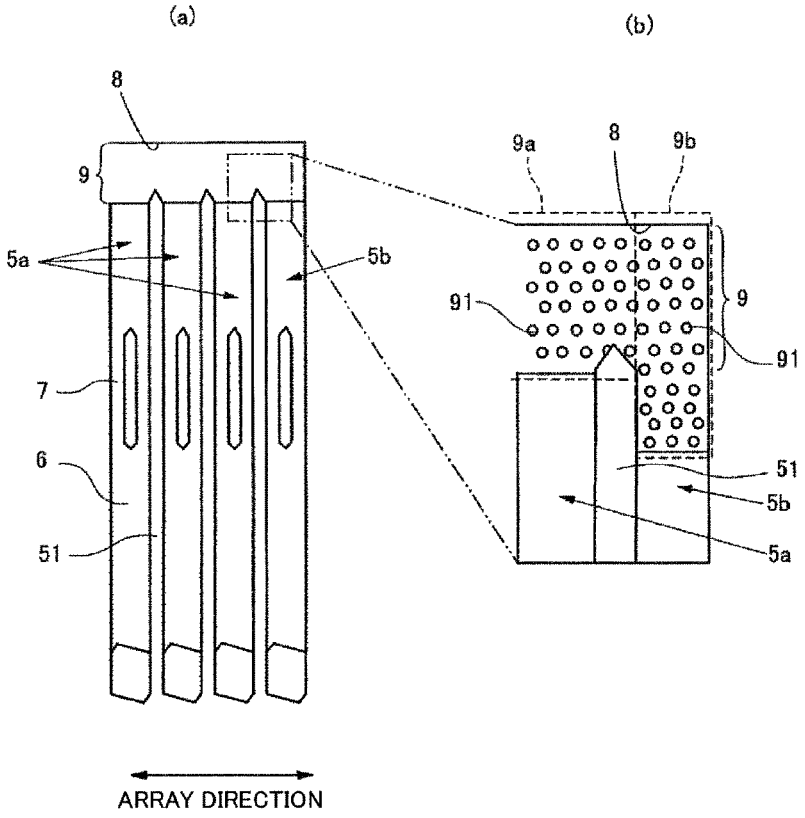
FIG. 18 is a plan view of a liquid introducing part and individual channels of an eighth embodiment of the present invention.

In the following, an eighth embodiment of the present invention is described with reference to FIG. 18. FIG. 18 is a plan view of the liquid introducing part 8 and the first and second individual channels 5*a* and 5*b* according to the eighth embodiment.

In the present embodiment, the area of the filter region 9*b* that faces the portion of the liquid introducing part 8 facing the second individual channel 5*b* is arranged to be larger than the area of a section of the filter region 9*a* that faces a portion of the liquid introducing part 8 facing one of the first individual channels 5*a* (i.e., a section of the filter region 9*a* across the width of one of the first individual channels 5*a* in the array direction) so that the fluid resistance of the filter region 9*b* may be lower than the fluid resistance of the filter region 9*a*.

With such a configuration, liquid from the common liquid chamber 10 may flow more easily into the liquid introducing part 8 through the filter region 9*b* that faces the portion of the liquid introducing part 8 facing the second individual channel 5*b* compared to the filter region 9*a* that faces the portion of the liquid introducing part 8 facing the first individual channel 5*a*.

In this way, liquid may be smoothly supplied to the second individual channel 5*b* so that liquid supply performance may be improved, for example. Also, the liquid flow rate may be increased so that air bubble discharge performance may be improved, for example.

It is noted that other preferred embodiments may be conceived by combining one or more features of the above-described embodiments, for example.

Also, although the liquid introducing part 8 is arranged into a continuous portion across the entire range of the individual channels 5 in the above descriptions, the present invention is not limited to such a configuration. For example, at least three individual channels 5 may be regarded as one individual channel group and the liquid introducing part 8 may be separately provided for each individual channel groups. In such a case, the individual channels 5 of each individual channel group may be regarded as the first individual channel 5*a* or the second individual channel 5*b* and the individual channel group may be arranged to have a configuration according to one or more of the above-described embodiments.

Figure 19:
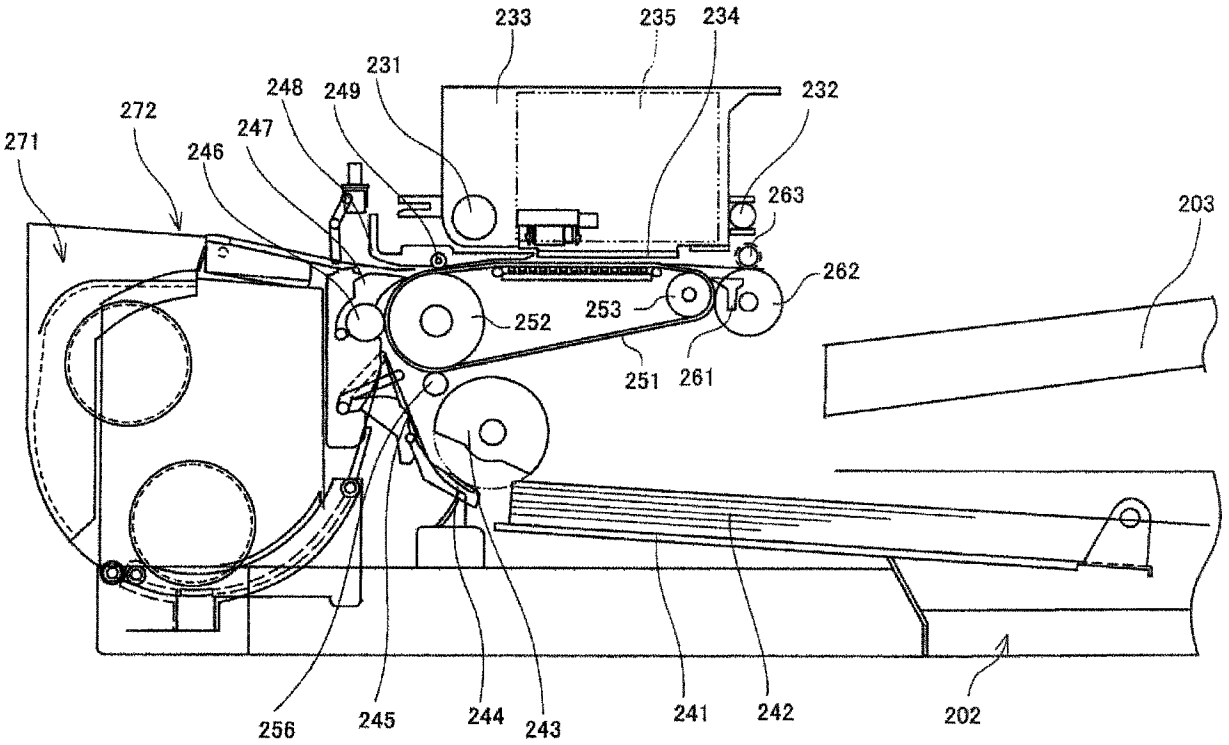
FIG. 19 is a side view of an exemplary image forming apparatus including a liquid discharge head of the present invention.
Figure 20:
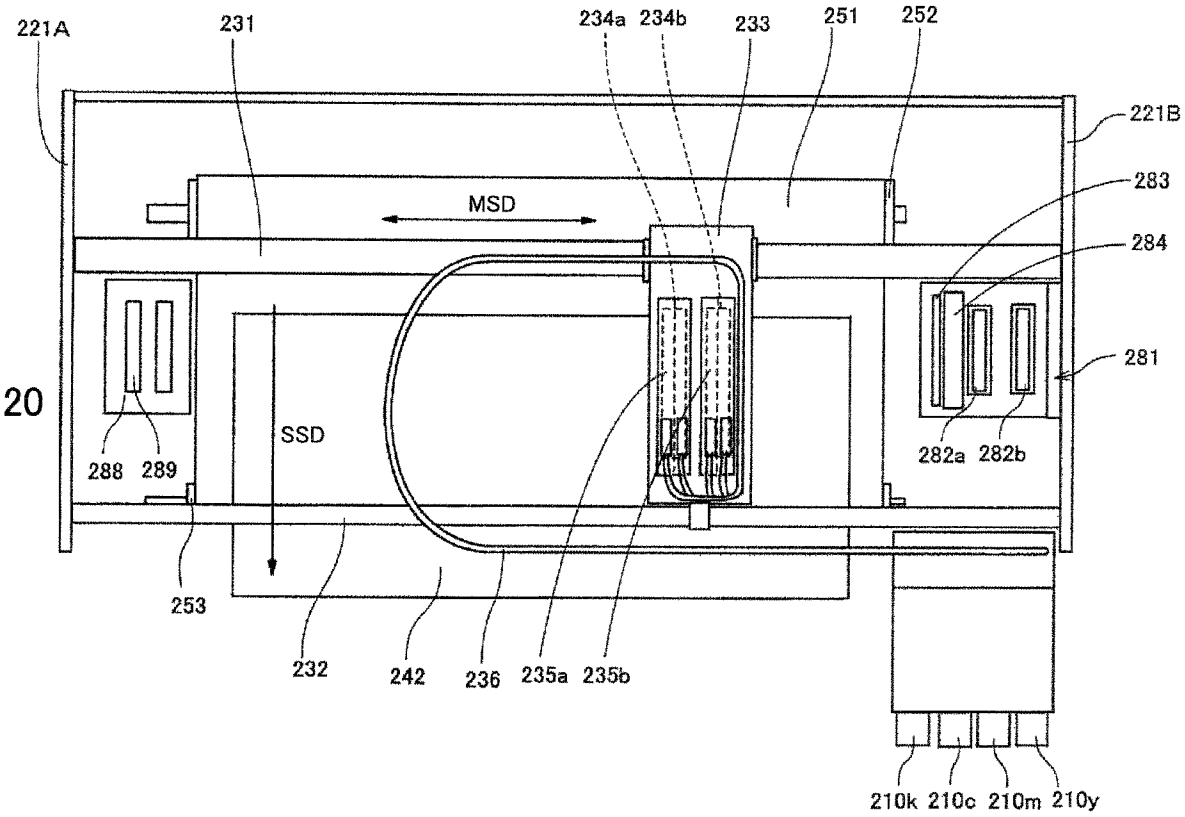
FIG. 20 is a plan view of the image forming apparatus.

In the following, an exemplary configuration of an image forming apparatus having a liquid discharge head according to an embodiment of the present invention is described with reference to FIGS. 19 and 20. FIG. 19 is a side view of the image forming apparatus, and FIG. 20 is a plan view of the image forming apparatus.

The image forming apparatus is a serial-type image forming apparatus and includes a main left-side plate 221A, a main right-side plate 221B, a main guide rod 231, a sub guide rod 232, and a carriage 233. The main guide rod 231 and the sub guide rod 232 acting as guide members extend between the main side plates 221A and 221B to support the carriage 233. The carriage 233 supported by the main guide rod 231 and the sub guide rod 232 is slidable in a main scanning direction indicated by an arrow MSD shown in FIG. 20. The carriage 233 is reciprocally moved for scanning in the main scanning direction by a main scanning motor via a timing belt (not shown).

On the carriage 233 is mounted a recording head 234 including liquid discharge head units 234*a* and 234*b*. Each of the liquid discharge head units 234*a* and 234*b* may include the liquid discharge head according to any of the above-described exemplary embodiments to discharge ink droplets of different colors, for example, yellow (Y), cyan (C), magenta (M), and black (K), and a sub tank integrally molded with the liquid discharge head to store ink supplied to the liquid discharge head. The recording head 234 is mounted on the carriage 233 so that multiple nozzle rows each including multiple nozzles are arranged parallel to a sub scanning direction (indicated by an arrow SSD shown in FIG. 20) perpendicular to the main scanning direction MSD and ink droplets are discharged downward from the nozzles.

In the recording head 234, the liquid discharge head units 234*a* and 234*b* each have two nozzle rows, for example, and one of the liquid discharge head unit 234*a*/234*b* may be arranged to discharge droplets of black (K) ink from one of the nozzle rows and droplets of cyan (C) ink from the other one of the nozzle rows, and the other one of the liquid discharge head unit 234*a*/234*b* may be arranged to discharge droplets of magenta (M) ink from one of the nozzle rows and droplets of yellow (Y) ink from the other one of the nozzle rows. It is noted that although the recording head 234 in the present embodiment is arranged to have two liquid discharge heads for discharging liquid droplets of four colors, the present invention is not limited to such an embodiment. For example, the recording head may have one single liquid discharge head having four nozzle rows that discharge ink droplets of four different colors.

A supply unit 224 replenishes different color inks from corresponding ink cartridges 210 to sub tanks 235 of the recording head 234 via supply tubes 236 for the respective color inks.

The image forming apparatus further includes a sheet feed section that feeds a sheet 242 stacked on a sheet stack portion (platen) 241 of a sheet feed tray 202. The sheet feed section further includes a sheet feed roller 243 that separates the sheet 242 from the sheet stack portion 241 and feeds the sheet 242 one at a time and a separation pad 244 that is disposed opposite the sheet feed roller 243. The separation pad 244 is made of a material of a high friction coefficient and urged toward the sheet feed roller 243.

To feed the sheet 242 from the sheet feed section to an area below the recording head 234, the image forming apparatus includes a first guide member 245 that guides the sheet 242, a counter roller 246, a conveyance guide member 247, a regulation member 248 including a front-end press roller 249, and a conveyance belt 251 that electrostatically attracts the sheet 242 and conveys the sheet 242 to a position facing the recording head 234.

The conveyance belt 251 is an endless belt that is looped between a conveyance roller 252 and a tension roller 253 so as to circulate in a belt conveyance direction, that is, the sub scanning direction (SSD). A charging roller 256 is provided to charge a surface of the conveyance belt 251. The charging roller 256 is arranged to be in contact with the surface of the conveyance belt 251 and is configured to be rotated by the circulation of the conveyance belt 251. When the conveyance roller 252 is rotationally driven by a sub scanning motor via a timing roller (not shown), the conveyance belt 251 circulates in the belt conveyance direction SSD shown in FIG. 20.

The image forming apparatus further includes a sheet output section for outputting the sheet 242 having an image formed thereon by the recording head 234. The sheet output section includes a separation claw 261 to separate the sheet 242 from the conveyance belt 251, a first output roller 262, and a second output roller 263. Additionally, a sheet output tray 203 is disposed below the first output roller 262.

A duplex unit 271 is removably mounted on a rear face portion of the image forming apparatus. When the conveyance belt 251 rotates in a reverse direction to move the sheet 242 backwards, the duplex unit 271 receives the sheet 242 and turns the sheet 242 upside down to feed the sheet 242 between the counter roller 246 and the conveyance belt 251. A manual-feed tray 272 is arranged at the top face of the duplex unit 271.

Also, a maintenance unit 281 for maintaining and restoring conditions of the nozzles of the recording head 234 is arranged at a non-print area on one end in the main scanning direction MSD of the carriage 233. The maintenance unit 281 includes cap members 282*a* and 282*b* (hereinafter collectively referred to as "caps 282" unless distinguished) to cover nozzle faces of the recording head 234, a wiping blade 283 acting as a blade member for wiping the nozzle faces of the recording head 234, and a first droplet receiver 284 that stores liquid droplets that are discharged during idle discharge operations in which liquid droplets not contributing to image recording are discharged to discard increased-viscosity recording liquid.

Further, a second droplet receiver 288 is disposed at a non-print area on the other end in the main scanning direction MSD of the carriage 233. The second droplet receiver 288 stores liquid droplets not contributing to image recording that are discharged to discard increased-viscosity recording liquid during image recording operations, for example. The second droplet receiver 288 has openings 289 arranged in parallel with the nozzles rows of the recording head 234.

In the image forming apparatus having the above-described configuration, the sheet 242 is fed one at a time from the sheet feed tray 202, to be guided in a substantially vertically upward direction along the first guide member 245, and conveyed while being sandwiched between the conveyance belt 251 and the counter roller 246. Further, the front tip of the sheet 242 is guided by the conveyance guide 237 and pressed by the front-end press roller 249 against the conveyance belt 251 so that the traveling direction of the sheet 242 is changed approximately 90 degrees.

At this time, plus outputs and minus outputs, i.e., positive and negative supply voltages are alternately applied to the charging roller 256 so that the conveyance belt 251 is charged with an alternating voltage pattern, that is, an alternating band pattern of positively-charged areas and negatively-charged areas in the sub-scanning direction SSD, i.e., the belt circulation direction. When the sheet 242 is transferred onto the conveyance belt 251 that is alternately charged with positive and negative charges, the sheet 242 is electrostatically attracted to the conveyance belt 251 and conveyed in the sub scanning direction SSD by the circulation of the conveyance belt 251.

By driving the recording head 234 in response to image signals while moving the carriage 233, ink droplets are discharged on the sheet 242 that is comes to a halt below the recording head 234 to form one line of a desired image. Then, the sheet 242 is moved by a predetermined distance to record a next line image. Upon receiving a signal indicating that the image has been recorded or that the rear end of the sheet 242 has reached the recording area, the recording head 234 finishes the recording operation and outputs the sheet 242 to the sheet output tray 203.

As described above, the image for apparatus can employ, as the recording head, the liquid discharge head according to any of the above-described exemplary embodiments, thus allowing stable formation of high-quality images.

It is noted that the term "sheet" as used in the above descriptions is not limited to a medium made of paper, but more broadly encompasses any type of medium on which liquid such as ink droplets may be held including an OHP (overhead projector) film, cloth, glass, and a substrate, for example. Moreover, the term generally encompasses any material that may be referred to as a recording medium, a recording sheet, or recording paper, for example. Also, it is noted that the terms "image formation," "recording," and "printing" are used synonymously in the above descriptions.

The term "image forming apparatus" is used to refer to any apparatus that forms an image by discharging liquid on a medium including paper, thread, fiber, cloth, leather, metal, plastic, glass, wood, and ceramic materials, for example. The term "image formation" is not limited to the rendering of an image having meaning such as a character or a figure, but also encompasses the rendering of an image without meaning such as a pattern (e.g., simply dropping liquid droplets on a medium), for example.

The term "ink" as used in the above descriptions is not limited to what is typically referred to as ink, but more broadly encompasses any type of liquid that may be used as an image forming agent including any type of recording liquid or fixing liquid such as DNA samples, resist materials, patterning materials, and resins, for example.

The term "image" as used in the above descriptions is not limited to a planar image and also encompasses an image rendered on a three-dimensional medium as well as an image of a three-dimensional object that is formed using a three-dimensional model, for example.

Further, the present invention is not limited to these embodiments, and numerous variations and modifications may be made without departing from the scope of the present invention.

The present application is based on and claims priority to Japanese Patent Application No. 2012-055171 filed on Mar. 12, 2012, and Japanese Patent Application No. 2012-059802 led on Mar. 16, 2012, the entire contents of which are hereby incorporated by reference.

What is claimed is:

1. A liquid discharge head comprising:

a plurality of nozzles that discharge liquid droplets;

a plurality of individual channels that are in communication with the nozzles;

a liquid introducing part that is in communication with the individual channels;

a common liquid chamber that supplies liquid to the individual channels;

a filter part that is arranged between the common liquid chamber and the liquid introducing part, the filter part being configured to filter the liquid over a range of the individual channels in a nozzle array direction; and a partition wall that partitions the individual channels; wherein an end portion of the partition wall towards the liquid introducing part is arranged to have a width in the nozzle array direction that becomes gradually narrower towards a tip of the partition wall; and at least a portion of the end portion of the partition wall is arranged to face the filter part.

2. The liquid discharge head as claimed in claim 1, wherein only the end portion of the partition wall having the width in the nozzle array direction becoming gradually narrower is arranged to face the portion of the filter part.

3. The liquid discharge head as claimed in claim 1, wherein the end portion of the partition wall is arranged into at least one of a tapered shape and a curved shape having a peak as viewed from an aspect facing the filter part.

4. The liquid discharge head as claimed in claim 1, wherein the end portion of the partition wall is arranged to be substantially perpendicular to a bottom face of the liquid introducing part.

5. The liquid discharge head as claimed in claim 1, wherein the end portion of the partition wall is arranged to be inclined with respect to a bottom face of the liquid introducing part in a flow direction of the liquid flowing from the liquid introducing part towards the individual channels.

6. The liquid discharge head as claimed in claim 1, wherein the individual channels include a first individual channel that has adjacent individual channels arranged at both sides in a channel array direction and a second individual channel that has an adjacent individual channel arranged at only one side in the channel array direction;

the filter part includes a first filter region that faces the first individual channel and a second filter region that faces the second individual channel; and a fluid resistance of the second filter region is arranged to be lower than a fluid resistance of the first filter region.

7. The liquid discharge head as claimed in claim 6, wherein a filter hole pitch of filter holes arranged at the second filter region is narrower than a filter hole pitch of filter holes arranged at the first filter region.

8. The liquid discharge head as claimed in claim 6, wherein a filter hole diameter of filter holes arranged at the second filter region is greater than a filter hole diameter of filter holes arranged at the first filter region.

9. The liquid discharge head as claimed in claim 6, wherein an area of the second filter region facing the second individual channel is arranged to be greater than an area of the first filter region facing the first individual channel.

10. An image forming apparatus comprising a liquid discharge head that includes:

a plurality of nozzles that discharge liquid droplets;

a plurality of individual channels that are in communication with the nozzles;

a liquid introducing part that is in communication with the individual channels;

a common liquid chamber that supplies liquid to the individual channels;

a filter part that is arranged between the common liquid chamber and the liquid introducing part, the filter part being configured to filter the liquid over a range of the individual channels in a nozzle array direction; and a partition wall that partitions the individual channels; wherein an end portion of the partition wall towards the liquid introducing part is arranged to have a width in the nozzle array direction that becomes gradually narrower towards a tip of the partition wall; and at least a portion of the end portion of the partition wall is arranged to face the filter part.

* * * * *